US011391428B2

(12) United States Patent
Bhakta et al.

(10) Patent No.: US 11,391,428 B2
(45) **Date of Patent: *Jul. 19, 2022**

(54) PIXELATED PROJECTION FOR AUTOMOTIVE HEADLAMP

(71) Applicant: Texas Instruments Incorporated, Dallas, TX (US)

(72) Inventors: Vikrant R. Bhakta, Dallas, TX (US); Jeffrey Scott Farris, Flower Mound, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/224,729

(22) Filed: Apr. 7, 2021

(65) Prior Publication Data

US 2021/0254807 A1 Aug. 19, 2021

Related U.S. Application Data

(63) Continuation of application No. 16/119,933, filed on Aug. 31, 2018, now Pat. No. 10,995,925, which is a (Continued)

(51) Int. Cl.

| | |
|---|---|
| ***F21S 41/25*** | (2018.01) |
| ***F21S 41/675*** | (2018.01) |
| ***F21S 41/153*** | (2018.01) |

(52) U.S. Cl.

CPC ..... *F21S 41/25* (2018.01); *F21S 41/153* (2018.01); *F21S 41/675* (2018.01)

(58) Field of Classification Search

CPC ..... F21S 41/25; F21S 41/675; F21S 41/141; F21S 41/153; F21S 41/16

See application file for complete search history.

(56) References Cited

U.S. PATENT DOCUMENTS 5,938,319 A 8/1999 Hege
6,497,503 B1 12/2002 Dassanayake et al.
(Continued)

OTHER PUBLICATIONS

Bhakta, et al., "High Resolution Adaptive Headlight Using Texas Instruments DLP Technology," 11th International Symposium of Automotive Lighting, Damstadt, Germany, Sep. 28-30, 2015, 11 pages.

(Continued)

*Primary Examiner* — Peggy A Neils

(74) *Attorney, Agent, or Firm* — Michelle F. Murray; Charles A. Brill; Frank D. Cimino

(57) ABSTRACT

An automotive headlamp is provided that includes a digital micromirror device (DMD) headlight module, the DMD headlight module including a DMD, a white light module to provide a white light beam to illuminate the DMD, illumination optics optically coupled between the DMD and the white light module to prepare the white light beam for illuminating the DMD, and projection optics optically coupled to the DMD to receive pixelated light reflected by the DMD and project a pixelated light beam on road, in which at least one of the DMD, the white light module, and the illumination optics shape a beam profile of the white light beam such that the light reflected by the DMD has a pixelated non-uniform beam profile suitable for projecting a white light beam that forms a portion of a white light beam of the headlamp.

20 Claims, 9 Drawing Sheets

Related U.S. Application Data continuation of application No. 14/752,825, filed on Jun. 26, 2015, now Pat. No. 10,066,799.

(60) Provisional application No. 62/167,588, filed on May 28, 2015, provisional application No. 62/017,514, filed on Jun. 26, 2014.

(56) References Cited

U.S. PATENT DOCUMENTS

| | | | |
|---|---|---|---|
| 6,969,183 | B2 | 11/2005 | Okubo et al. |
| 8,033,697 | B2 | 10/2011 | Fang et al. |
| 9,658,447 | B2 | 5/2017 | Bhakta |
| 9,702,519 | B2 | 7/2017 | Reiners |
| 10,066,799 | B2 | 9/2018 | Bhakta et al. |
| 2004/0114921 | A1 | 6/2004 | Braun et al. |
| 2010/0056928 | A1 | 3/2010 | Zuzak et al. |
| 2012/0113664 | A1 | 5/2012 | Park et al. |
| 2012/0127747 | A1 | 5/2012 | Ahn et al. |
| 2013/0058114 | A1 | 3/2013 | Reiners |

OTHER PUBLICATIONS

Doherty, et al., "10.4: Phased Reset Timing for Improved Digital Micromirror Device (DMD™) Brightness," SID Symposium Digest of Technical Papers, vol. 29, Issue 1, May 1998, pp. 125-128.

Schug, et al., "Dedicated Phosphor Developments for Future Laser Based Headlights," Proceeding of Vision 2014 Conference, Societe des Ingenieurs de L'Automobile, Versailles, France, Oct. 2014, 8 pages.

Tamburo, et al., "Programmable Automotive Headlights," Computer Vision—ECCV 2014, 13th European Conference Proceedings Part IV, Zurich Switzerland, Sep. 6-12, 2014, pp. 750-765.

PIXELATED PROJECTION FOR AUTOMOTIVE HEADLAMP

CROSS-REFERENCE TO RELATED APPLICATIONS

This is a Continuation Application of U.S. Non-Provisional patent application Ser. No. 16/119,933 filed Aug. 31, 2018, which is a Continuation Application of U.S. Non-Provisional application Ser. No. 14/752,825 filed Jun. 26, 2015, which claims benefit to U.S. Provisional Patent Application Ser. No. 62/167,588, filed May 28, 2015, and to U.S. Provisional Patent Application Ser. No. 62/017,514, filed Jun. 26, 2014, which Applications are hereby incorporated herein by reference in their entirety.

BACKGROUND OF THE DISCLOSURE

Field of the Disclosure

Embodiments of the present disclosure generally relate to headlamps, and more specifically relate to pixilated projection for headlamps.

Description of the Related Art

Various forms of glare free headlamps are currently implemented by several automotive manufacturers. In general, a glare free headlamp has a glare free high beam that is controlled by a camera-driven system to selectively shade areas out of the high beam pattern to protect other road users from glare, while providing the driver with maximum viewing range. The area surrounding other road users is constantly illuminated at high beam brightness, but without the glare that would result from using uncontrolled high beams in traffic.

While there are several approaches to achieving a glare free high beam in a headlamp, a current trend in automotive headlamps is to have pixel-level digital control over the high beam. Automotive manufacturers are already making vehicles with headlamps having versions of pixel-level control using light emitting diode (LED) matrix technology. However, the maximum resolution available in any of these LED matrix solutions is less than one hundred segments. Limited resolution can cause stark changes to the light output as a masked object moves across the headlight field of view. In addition, as one LED is turned off and another turned on, the change may be noticeable and even distracting to the driver of the equipped vehicle as well as to oncoming drivers. Accordingly, some industry and research attention are focusing on the possibility of pixilated projector-based headlamps that offer much higher pixel resolution.

SUMMARY

Embodiments of the present disclosure relate to methods and apparatus for pixelated projection in an automotive headlamp. In one aspect, an automotive headlamp includes a digital micromirror device (DMD) headlight module, the DMD headlight module including a DMD, a white light module to provide a white light beam to illuminate the DMD, illumination optics optically coupled between the DMD and the white light module to prepare the white light beam for illuminating the DMD, and projection optics optically coupled to the DMD to receive pixelated light reflected by the DMD and project a pixelated light beam on road, in which at least one of the DMD, the white light module, and the illumination optics shape a beam profile of the white light beam such that the light reflected by the DMD has a pixelated non-uniform beam profile suitable for projecting a white light beam that forms a portion of a white light beam of the headlamp, the white light beam of the headlamp including low beam light, mid-beam light, and high beam light portions.

BRIEF DESCRIPTION OF THE DRAWINGS

Particular embodiments will now be described, by way of example only, and with reference to the accompanying drawings.

DETAILED DESCRIPTION OF EMBODIMENTS OF THE DISCLOSURE

Figure 1A:
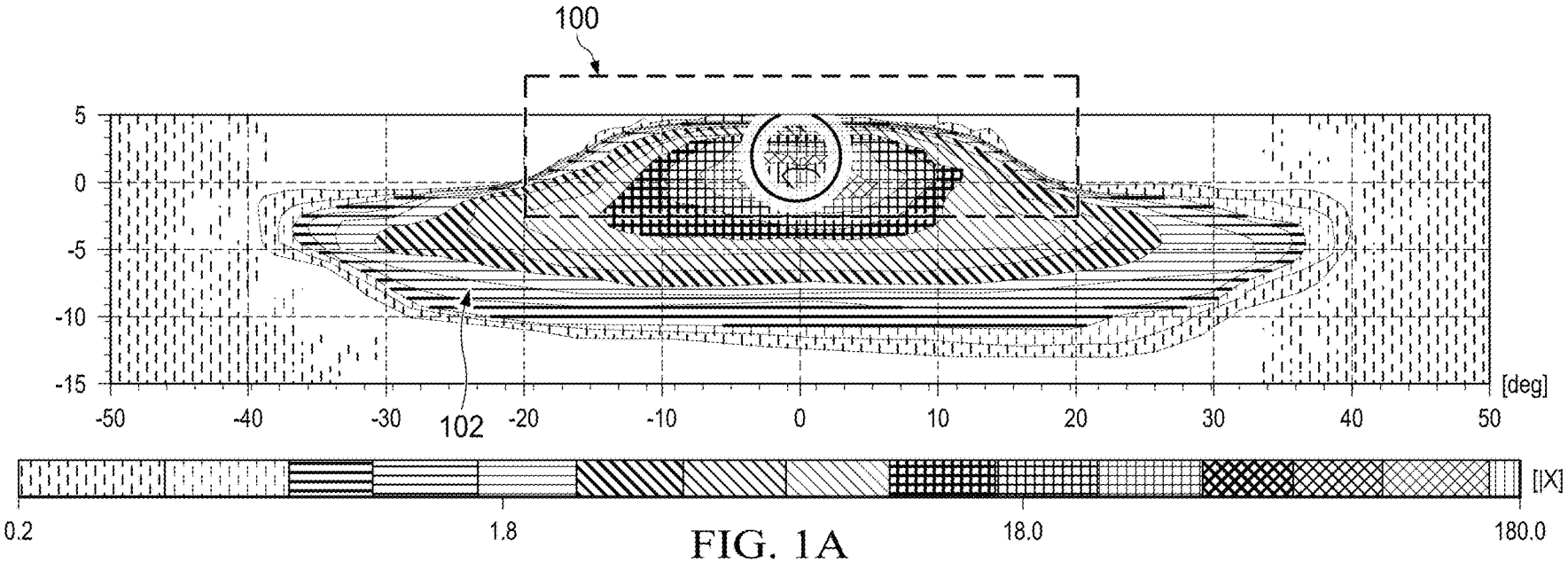
FIGS. 1A and 1B are graphs illustrating the beam profile of a typical automotive high beam.

Specific embodiments of the disclosure will now be described in detail with reference to the accompanying figures. Like elements in the various figures are denoted by like reference numerals for consistency.

Figure 1B:
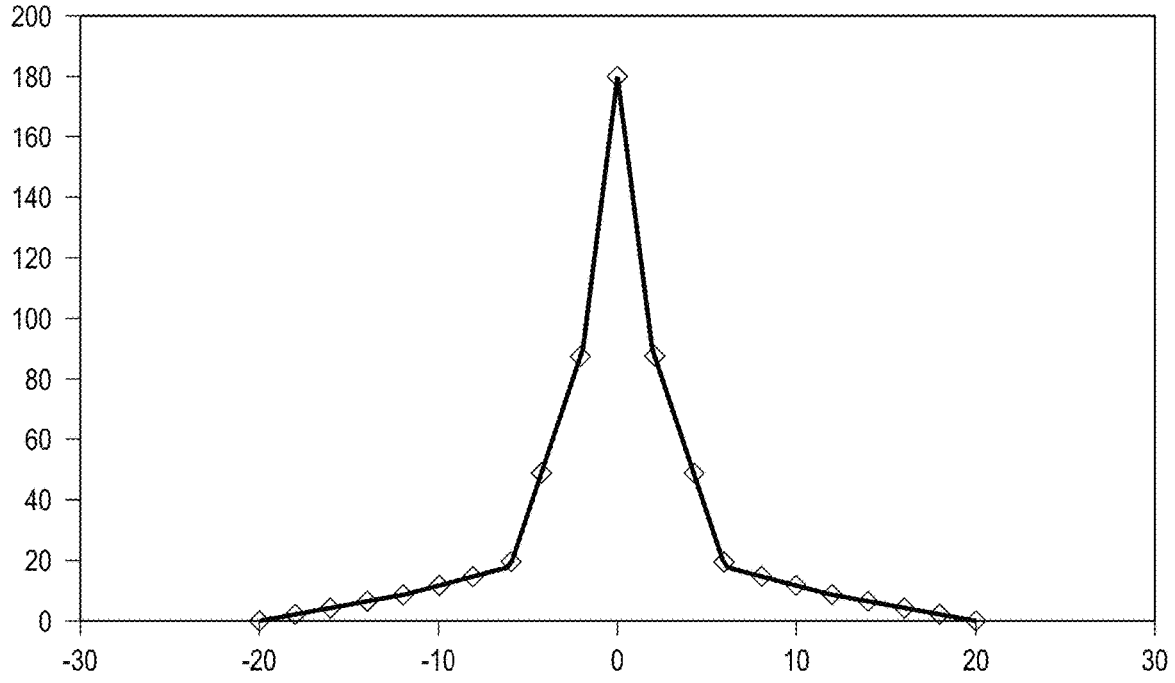

FIGS. 1A and 1B are graphs illustrating the beam profile of a typical high beam with both headlamps of a vehicle are in high beam mode. Referring first to FIG. 1A, the distribution 100 of the high beam in the field of view (FOV) is approximately between −20 degrees and 20 degrees. The distribution 102 of the low beam in the FOV is much broader, approximately between −40 degrees and 40 degrees. The circle indicates the spot within the high beam where peak intensity is highest. This is where a headlamp needs the highest intensity so the driver can see as far as possible down the road. FIG. 1B is a plot of the one dimensional distribution of the light in the high beam profile 100. As can be seen from this plot, the high beam has very high intensity in the center and the intensity falls off rapidly away from the center.

Embodiments of the disclosure provide for achieving the required high beam profile in an automotive headlamp incorporating a pixelated projector based on a digital micromirror device (DMD), e.g., a digital light processing (DLP®) projector. In some embodiments, the forward lighting is segmented into areas based on brightness and/or field of view (FOV) and the area where the benefit of pixilation is the strongest is assigned to the pixilated projector. In some such embodiments, a booster module is used to generate the high intensity light needed for the high beam while the DMD-based projector is used to generate mid-beam light. In some embodiments, beam profile shaping is performed to generate a non-uniform beam profile needed for generating the mid-beam light, i.e., a mid-beam profile. In various embodiments, the beam profile shaping may be performed by the DMD, the illumination optics, or laser illumination of a phosphor converter, or a combination of the DMD and one or more of the other components.

Figure 3:
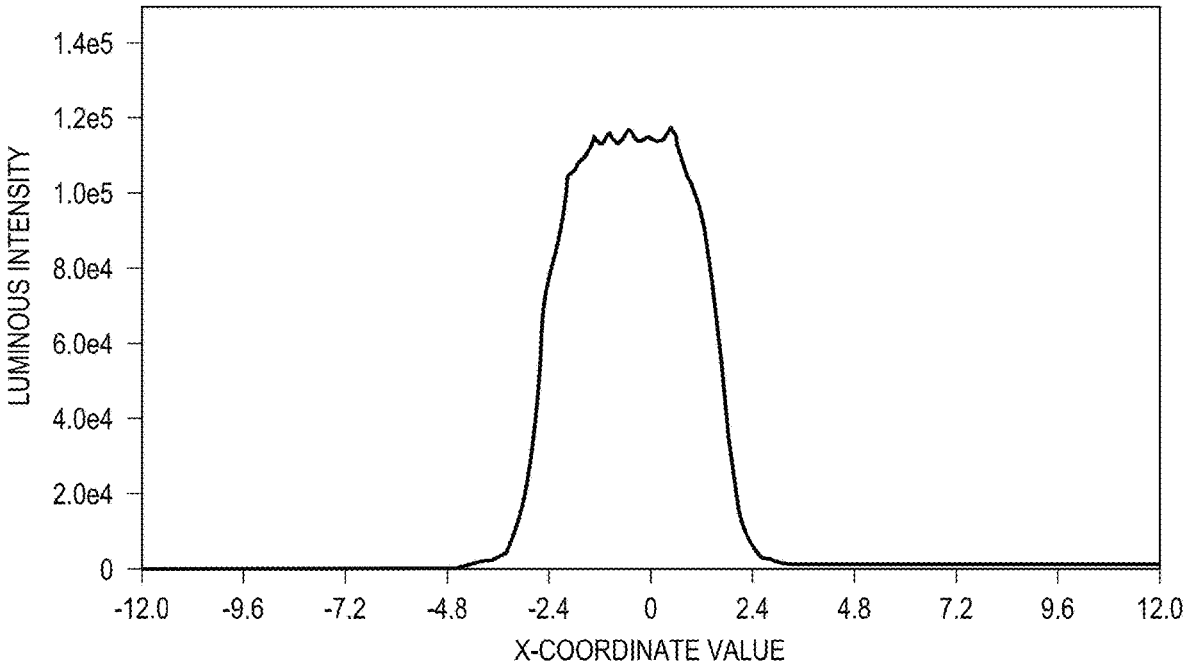
FIGS. 3-5 are graphs illustrating beam profiles of a high beam booster module, a digital micromirror device (DMD) headlight module, and from both modules.
Figure 2:
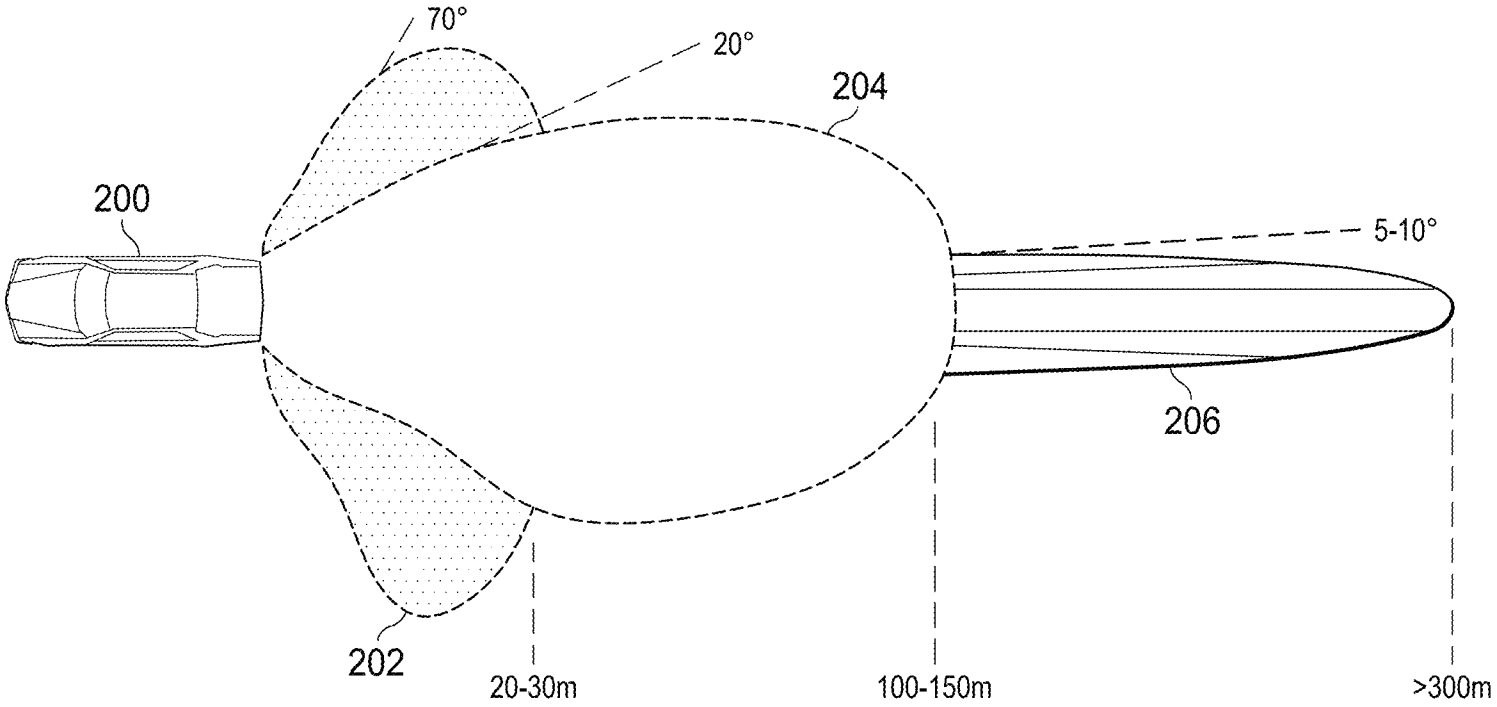
FIG. 2 is an example illustrating operation of tri-beam headlamps.

FIG. 2 is an example illustrating operation of tri-beam headlamps in accordance with some embodiments. A top view perspective of the composition of the light generated by the tri-beam headlamps installed in a vehicle 200 is shown. In this example, the forward light is segmented based on distance (FOV). As is explained in further detail herein, each tri-beam headlamp incorporates a DMD projector with associated optics, i.e., a DMD headlight module, and a high beam booster module. The high beam booster module generates light with a narrow FOV and peak intensity needed to boost the mid-beam light from the DMD headlight module to provide high beam light 206 in an automotive headlamp, e.g., at the FOV and intensity of the center part of the high beam profile shown in FIG. 1B. FIG. 3 is a graph showing the high beam profile of the light from an embodiment of the booster module.

Figure 4:
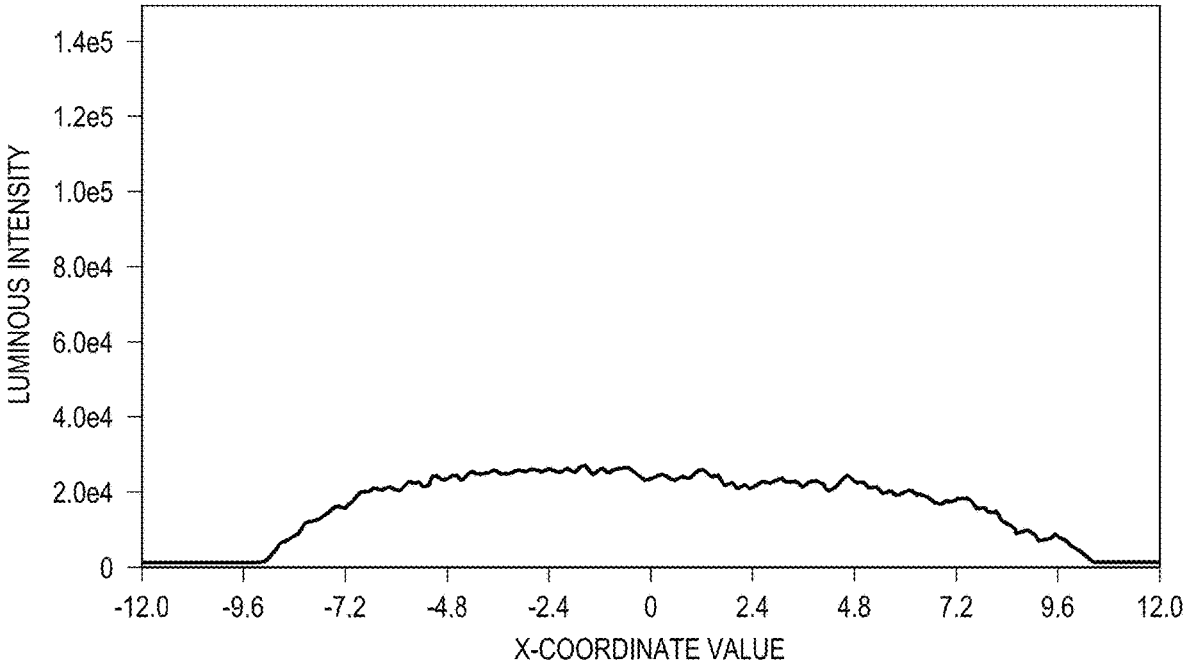
Figure 5:
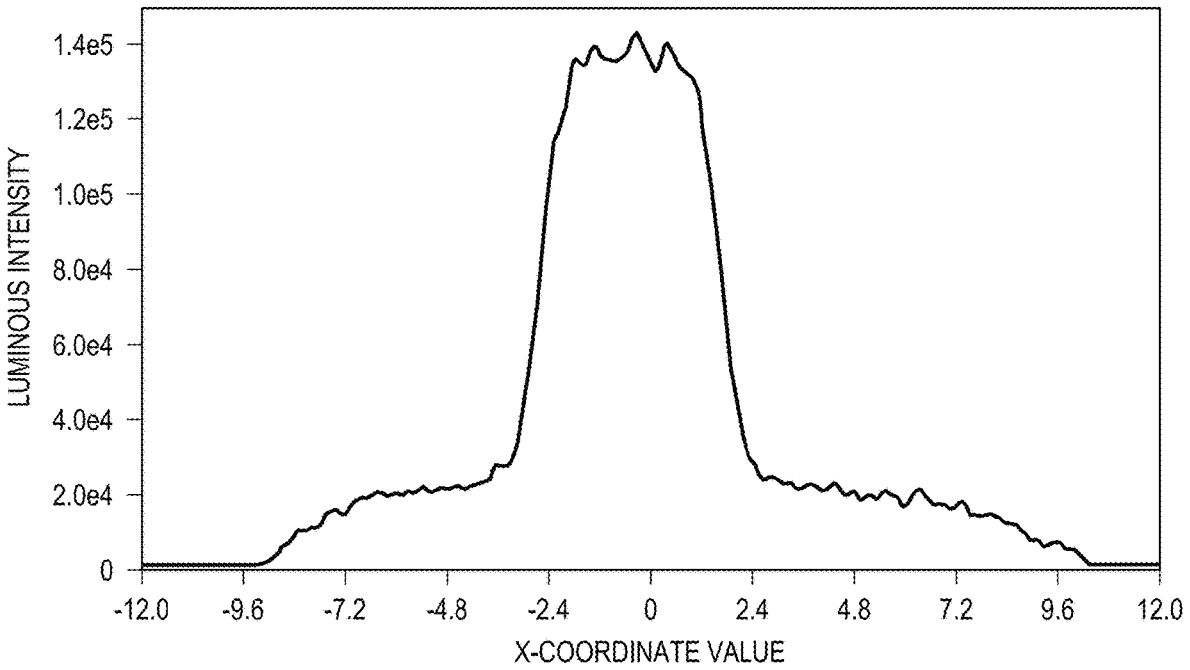

The DMD headlight module generates mid-beam light 204 with a broader FOV and lower peak intensity needed for mid-range light in an automotive headlamp. FIG. 4 is a graph showing the mid-beam profile of the light from an embodiment of the DMD headlight module. FIG. 5 is a graph showing the beam profile of the combined light from the DMD headlight module embodiment and the booster module embodiment. The low beam light 202 is provided by another light module in the headlamp such as an LED light module or a halogen light module. The combined light from the three modules has a beam profile suitable for an automotive headlamp, e.g., similar to the beam profile of FIG. 1A.

The beam profiles of the light from each of the modules may be determined based on factors such as automotive regulations where the headlamp is to be used and headlamp styling. For example, typical low beam light of prior art headlamps covers a horizontal FOV of approximately 40 degrees to the left of center and 40 degrees to the right of center, with peak intensity up 35,000 candela. Further, typical high beam light of prior art headlamps covers a horizontal FOV of approximately 12 degrees to the left of center and 12 degrees to the right of center, with a peak intensity between 40,000 to 75,000 candela. The beam profiles of light from each of the modules may be determined based on these numbers for headlamps to be used in the United States.

Figure 6:
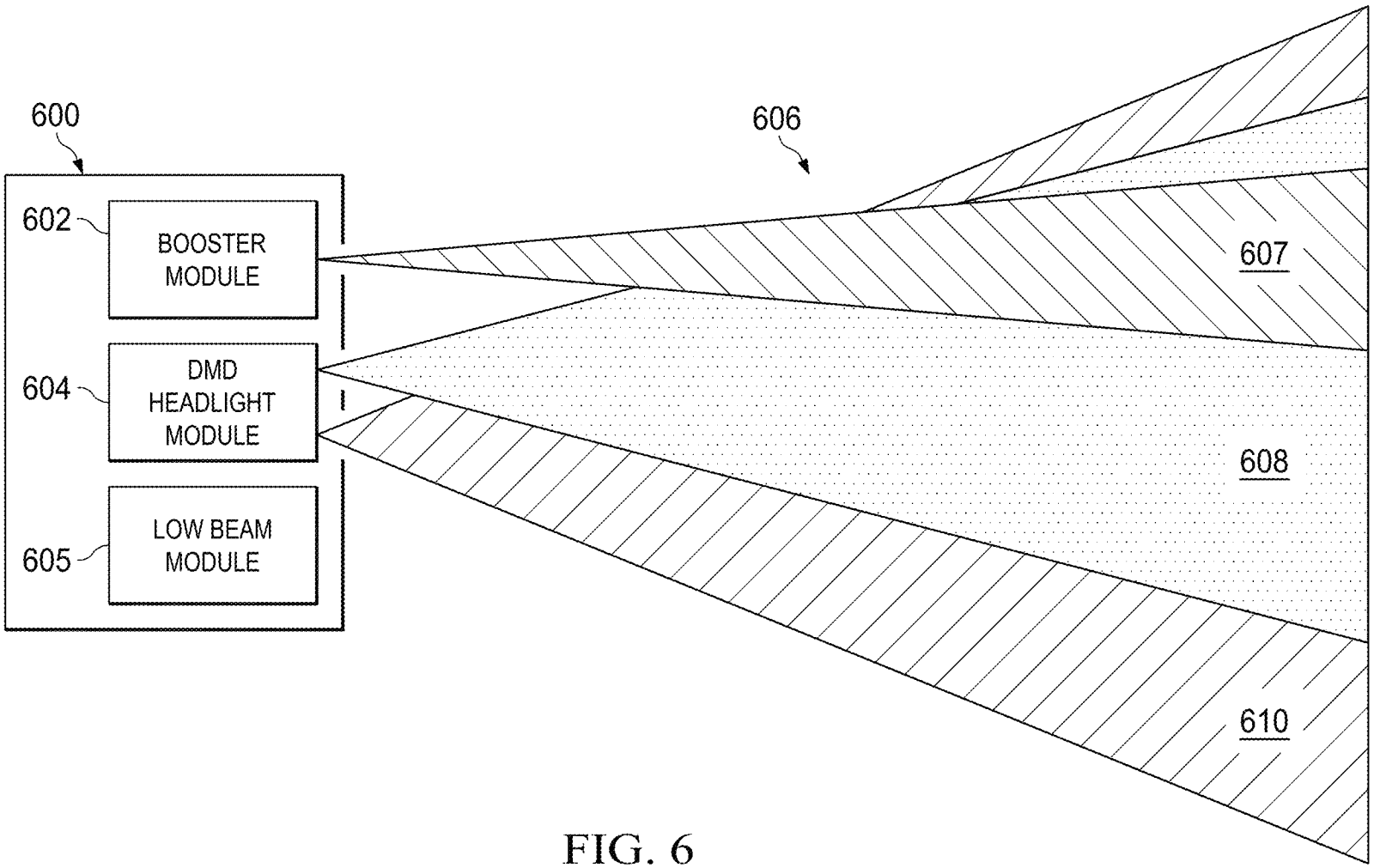
FIG. 6 is a simplified block diagram of an example headlamp incorporating a high beam booster module and a DMD headlight module.

FIG. 6 is a simplified block diagram of an example headlamp 600 incorporating a high beam booster module 602, a DMD headlight module 604, and a low beam module 605. The booster module 602 provides narrow FOV, high intensity light to boost the light from the DMD headlight module 604 for the high beam portion 607 of the total light beam 606. Mid-range light from the DMD headlight module 604 provides the broader FOV, lower intensity mid-range portion 608 of the beam 606. Low-range light from the low beam module 605 provides the broader FOV, lower intensity low-range portion 610 of the beam 606. The low beam module 605 may be, for example, an LED light module or a halogen light module. Note that the targeted high beam profile, mid-beam profile, and low beam profile of light from these modules may vary in embodiments depending on automotive regulations where the headlamp is to be used. Power consumption and headlamp styling may also be considered.

Figure 7:
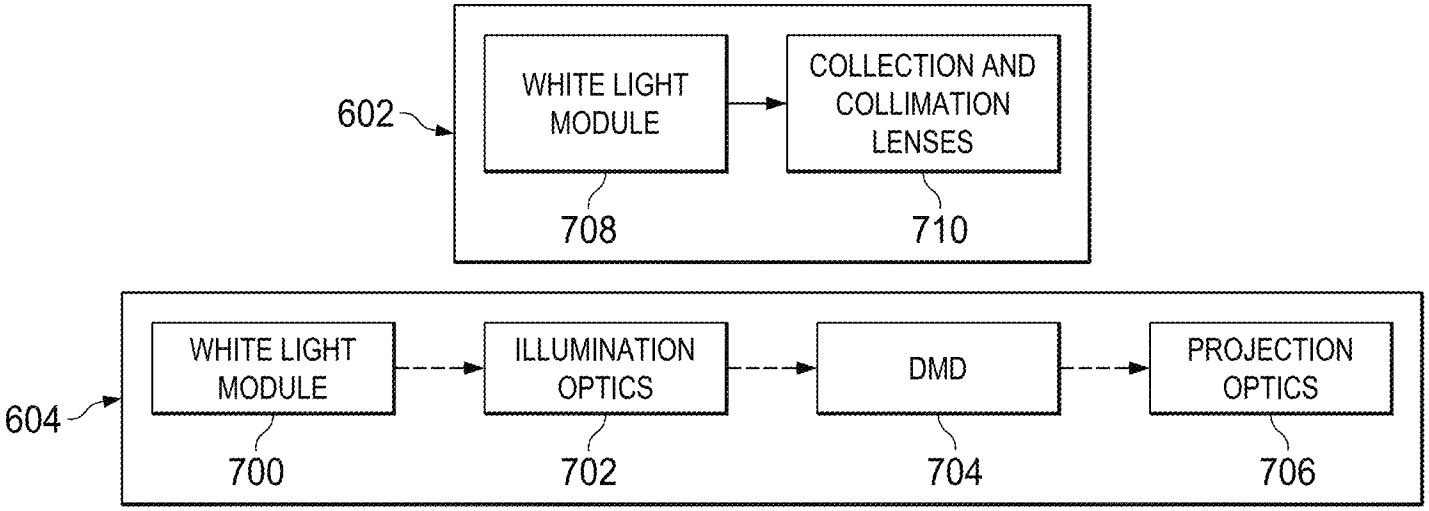
FIG. 7 shows high level block diagrams of embodiments of the high beam booster module and the DMD headlight module of FIG. 6.

FIG. 7 shows high level block diagrams of an embodiment of the high beam booster module 602 and an embodiment of the DMD headlight module 604 of FIG. 6. The booster module 602 provides narrow FOV, high intensity white light suitable for boosting mid-range light from the DMD headlight module 604 to form the high beam 607 of FIG. 6. The collection and collimating lenses 710 condense and collimate the white light beam to form a collimated light beam that illuminates the scene in front of the module. The white light module 708 includes a white light source and optics to generate a white light beam with a desired high beam profile. The white light source may be, for example, a single white LED, a laser and phosphor combination that yields white light, a one-dimensional LED array, or a two-dimensional LED array.

In the DMD headlight module 604, the white light module 700 provides a white light beam to the optically coupled illumination optics 702. The white light module 700 includes a white light source and optics, if needed, to form the white light from the white light source into an appropriate white beam for the illumination optics 702. The white light source may be, for example, a single white LED, multiple white LEDs, or a laser and phosphor combination that yields white light. Some example laser-phosphor embodiments that may be used are described in copending U.S. patent application Ser. No. 14/752,738, filed Jun. 26, 2015, which is incorporated by reference herein.

The illumination optics 702 prepare the white light beam to illuminate the optically coupled DMD 704. In general, the illumination optics 702 create a pixilated (pixel addressable) beam profile on the DMD 704. The DMD 704 amplitude modulates the white light beam from the illumination optics 702 at the pixel level to generate pixilated light that is reflected to the optically coupled projection optics 706. The projection optics 706, which may be an imaging projection lens, capture the reflected pixilated light and project the pixilated light on the road.

The distribution of the white light, i.e., the beam profile, on the DMD 704 should be non-uniform such that there is higher intensity near the center which monotonically decreases away from the center in a curve approximating the desired mid-beam profile for the mid-range portion 608 of FIG. 6. In some embodiments, the non-uniform distribution of the desired mid-beam profile may be generated through the use of light sculpting using the DMD 704. As is well known, almost any beam profile can be created using a DMD as long as the profile is within the beam profile with all mirrors of the DMD in the on state. A pixilated (pixel addressable) non-uniform beam profile can be created, i.e., sculpted, by controlling gray scale using pulse width modulation techniques. In embodiments in which the DMD 704 alone is used to generate the mid-beam profile, the white light from the illumination optics 702 has a uniform distribution beam profile that is sculpted using the DMD 704 such that the reflected pixelated light has the desired mid-beam profile.

In some embodiments, the illumination optics 702 shape the white light distribution to the desired mid-beam profile. The illumination optics 702 may be imaging or non-imaging. For non-imaging illumination optics, a beam shaping lens with a freeform surface may be used, for example, to alter the distribution of the white light beam to the desired mid-beam distribution. Non-sequential ray tracing and optimization algorithms may be used to design such illumination optics. For imaging illumination optics, a higher order aspheric lens may be used to alter the distribution of the white light beam to the desired mid-beam distribution. In such illumination optics, a biconic lens may also be used to correct the aspect ratio mismatch between the white light source and DMD.

Figure 8A:
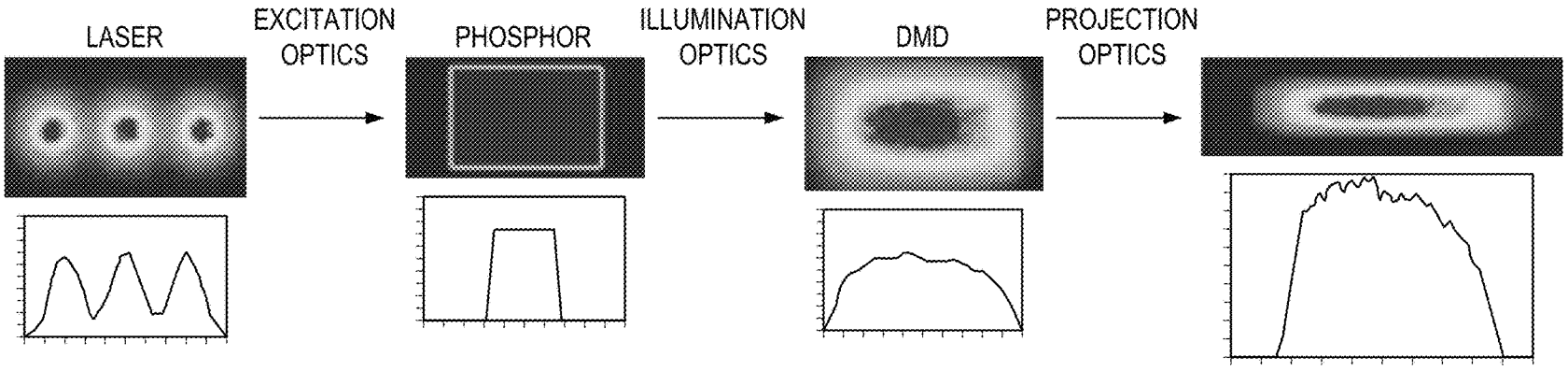
FIGS. 8A and 8B are examples of beam shaping in embodiments of the DMD head light module of FIG. 7.

FIG. 8A is a simple example illustrating this optical beam shaping assuming the white light source is a laser-phosphor combination. In this example, as illustrated by the various graphs, the distribution of the laser light is non-uniform and the distribution of the white light created by applying a laser excitation beam to the phosphor is uniform. The illumination optics reshape the uniform distribution of the white light to have the desired mid-beam profile. The DMD is illuminated by the resulting white light from the illumination optics and reflects pixilated light with the desired mid-beam profile.

In some embodiments in which the white light source is a laser-phosphor combination, a white light beam with desired mid-beam profile may be generated in the white light module 700. Assuming that the phosphor is yellow, to generate light with the desired mid-beam profile, a high intensity Gaussian spot may be created on the phosphor with a blue laser light excitation beam formed from a blue laser light beam from a single blue laser diode or formed from a combination of blue laser light beams from multiple blue laser diodes. If a yellow phosphor is illuminated with a uniform spot, e.g., top hat, the converted yellow light will also be uniform; if a yellow phosphor is illuminated with a Gaussian spot, the converted yellow light will also be Gaussian.

Figure 8B:
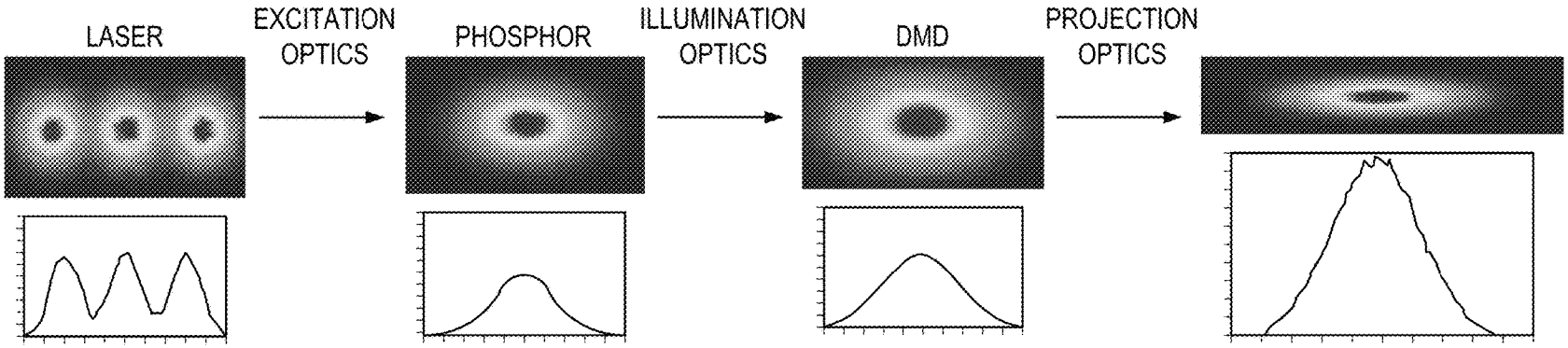

FIG. 8B is a simple example illustrating this laser beam shaping. In this example, as illustrated by the various graphs, the blue light out of the lasers has three separate Gaussian beam spots that are combined by the excitation optics to form a single Gaussian spot at the phosphor. Imaging illumination optics are used to image the single Gaussian spot onto the DMD. The projection lens projects the pixelated reflected light to the projection optics. The result is light having high peak intensity in the center of the field of view.

In some embodiments, the generation of white light with the desired mid-beam profile, i.e., the beam shaping, may be partially performed by some combination of the white light module 700, the illumination optics 702, and the DMD 704. For example, the illumination optics 702 may be designed to generate a white light beam with a non-uniform distribution that is then "sculpted" into the desired mid-beam profile by the DMD 704. In another example, laser beam shaping in the white light module 702 may generate a white light beam with a non-uniform distribution that is then "sculpted" into the desired mid-beam profile by the DMD 704. One of ordinary skill in the art will understand embodiments in which other combinations of these modules generate a white light beam with the desired mid-beam profile.

Referring back to FIG. 6, in some embodiments, the booster module 602 may be another DMD headlight module similar to the above described DMD head light module with a narrow FOV in which narrow FOV projection optics concentrate the light from the DMD.

Figure 9B:
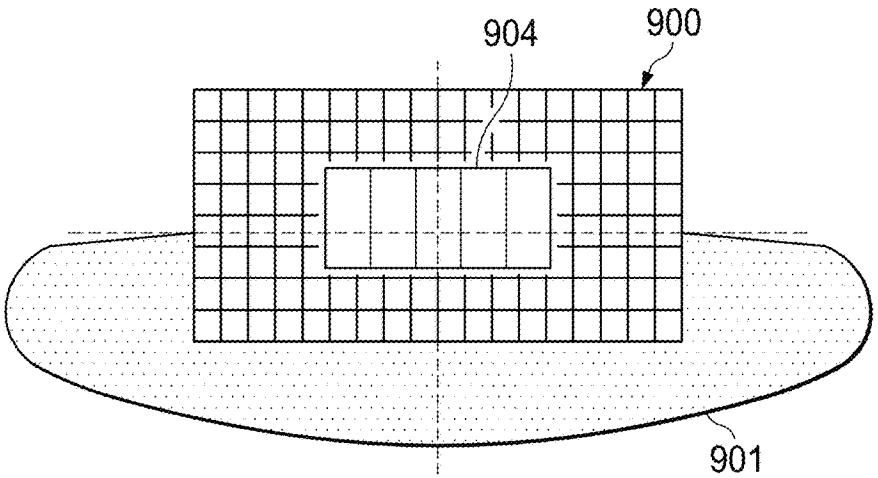
FIGS. 9A-9D are examples illustrating various embodiments of the high beam booster module in combination with the DMD headlight module.
Figure 9A:
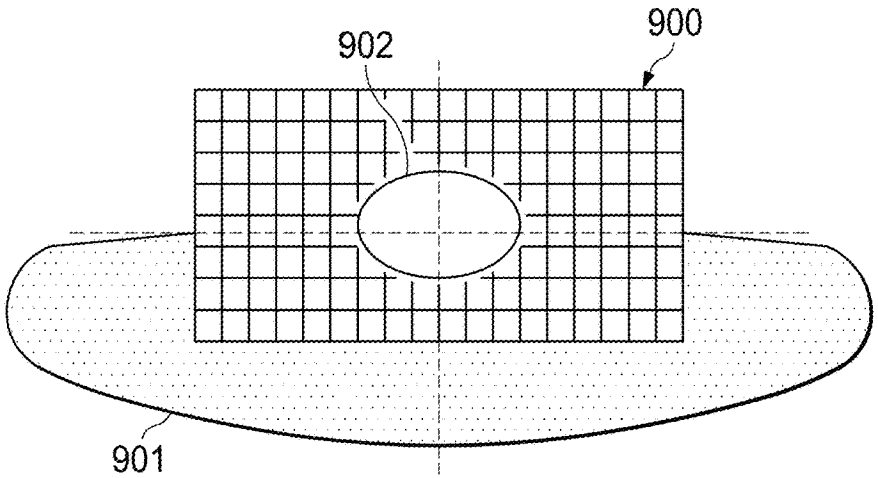

FIGS. 9A-9D are examples illustrating various embodiments of the booster module in combination with the DMD headlight module and the low beam module. In this example, the forward light is assumed to be segmented based on brightness. In each of these examples, the rectangular grid 900 represents the mid-beam light from the DMD headlight module and the roughly oval area 901 represents the low beam light from the low beam module. In FIG. 9A, the booster module incorporates either a white LED light emitter or a laser-phosphor white light source. The oval area 902 at the center represents the narrow FOV, high intensity white light from the booster module. In such embodiments, there is pixel level control over the light from the DMD headlight module and no pixel level control on the light from the booster module.

In FIG. 9B, the booster module incorporates an X×1 one-dimensional LED array as the white light source. The rectangular area 904 at the center represents the narrow FOV, high intensity white light from the booster module assuming that a 5×1 LED array is used. In such embodiments, there is pixel level control over the light from the DMD headlight module and some pixel level control, i.e., for X×1 pixels, on the light from the booster module.

Figure 9D:
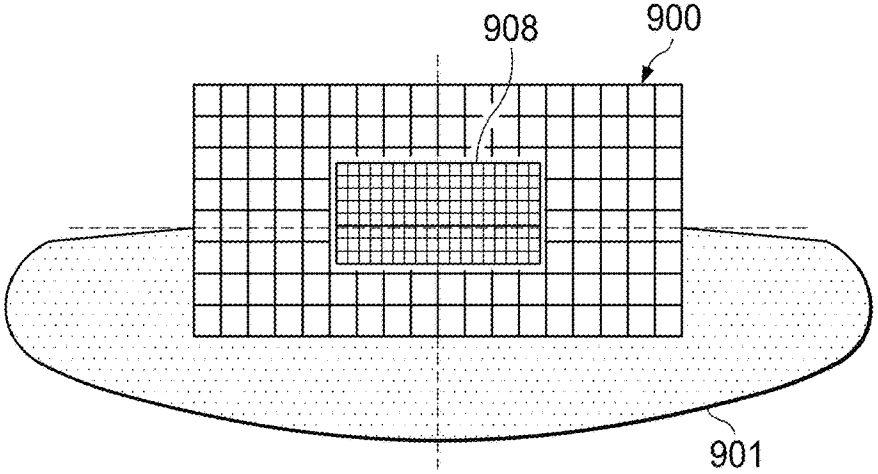
Figure 9C:
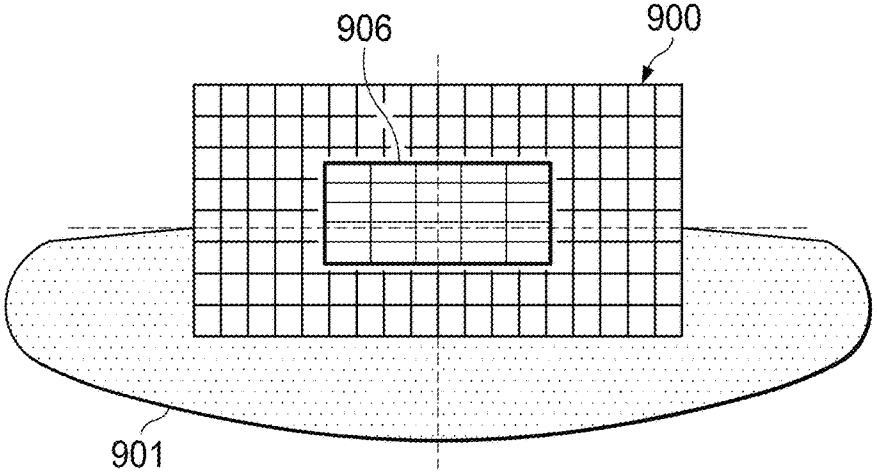

In FIG. 9C, the booster module incorporates an X×Y two-dimensional LED array as the white light source. The rectangular area 906 at the center represents the narrow FOV, high intensity white light from the booster module assuming that a 5×5 LED array is used. In such embodiments, there is pixel level control over the light from the DMD headlight module and some pixel level control, i.e., for X×Y pixels, on the light from the booster module.

In FIG. 9D, the booster module incorporates another DMD headlight module with a narrow field of view as the booster module. The rectangular area 908 at the center represents the narrow FOV, high intensity white light from the booster module. In such embodiments, there is full pixel level control over both the light from the DMD headlight module and the light from the booster module. Note that the embodiments of FIG. 9B and FIG. 9C provide low resolution in the respective LED matrix regions 904, 906 while the embodiment of FIG. 9D provides high resolution across the entire beam.

Figure 10:
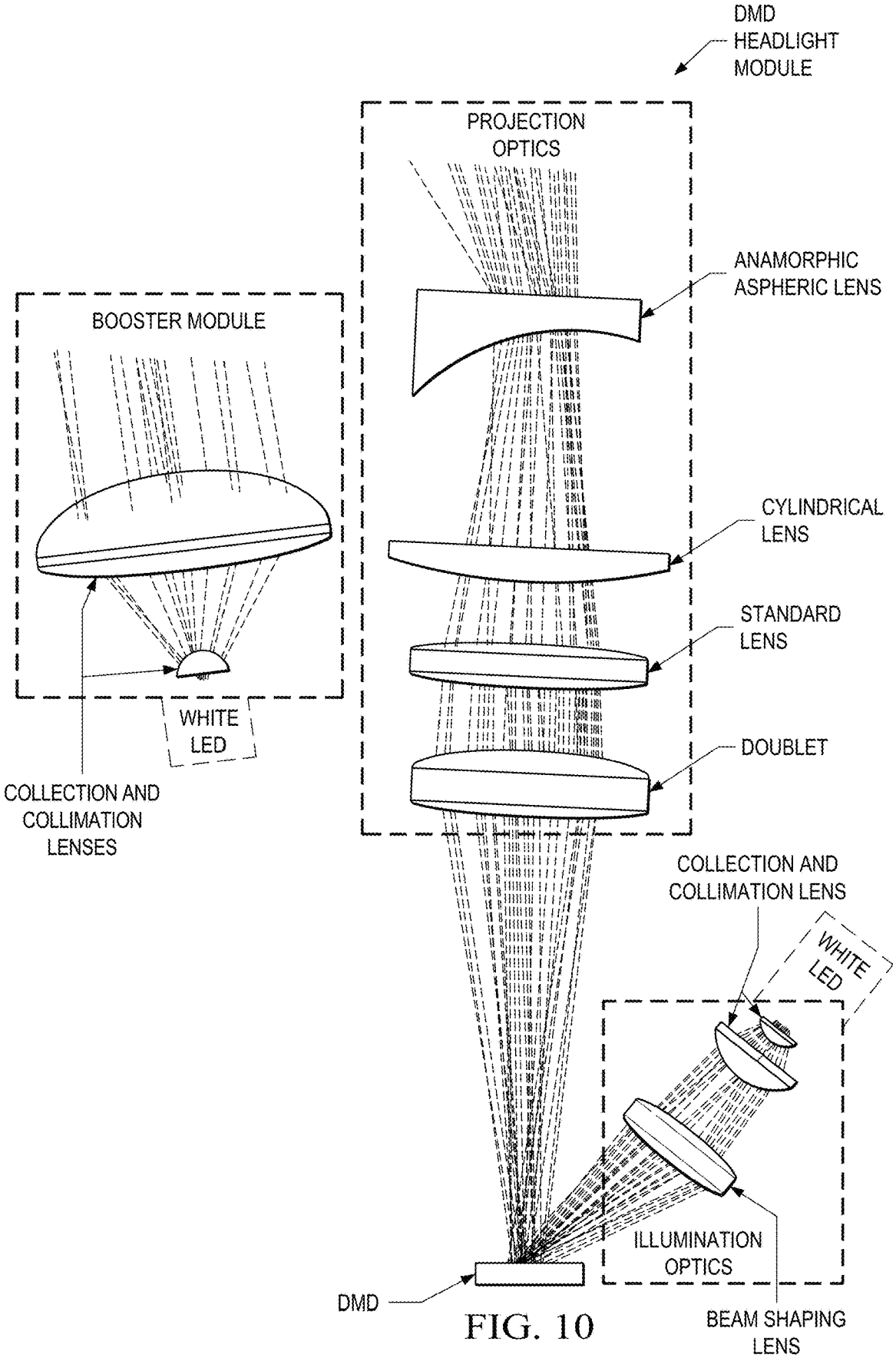
FIG. 10 shows an example architecture for a high beam booster module with a white LED light source and an example architecture for a DMD headlight module.

FIG. 10 shows an example architecture for a high beam booster module with a white LED light source and an example architecture for a DMD headlight module. A brief description of this architecture is provided herein. Additional details may be found in V. Bhakta and B. Ballard, "High Resolution Adaptive Headlight Using Texas Instruments DLP® Technology," accepted for publication, 11$^{th}$ International Symposium on Automotive Lighting, Sep. 28-30, 2015, Darmstadt, Germany, pp. 1-11, which is incorporated by reference herein. The high beam booster module includes a white LED, e.g., a white light source, and collection and collimation lenses optically coupled to the white LED to receive the white light emitted from the white LED. The collection and collimation lenses condense and collimate the white light to form a white light beam that illuminates the scene in front of the module.

Referring now to the DMD headlight module, a white LED provides the white light for the illumination optics. The illumination optics include a collection and collimating lens optically coupled to the LED to receive the white light and condense and collimate the light to form a collimated white light beam. The illumination optics also include a beam shaping lens optically coupled to the collection and collimating lens to control the shape, size, and light distribution of the collimated white light beam on the optically coupled DMD. Because there are no homogenizing elements in the illumination optics, the white light beam output by the illumination optics has a non-uniform beam profile. The beam shaping lens is designed to shape the profile of the white light beam to a desired mid-range profile.

The DMD may be any DMD suitable for use in a headlamp such as, for example, the 0.3-inch wide video graphics array (WVGA) DMD available from Texas Instruments Incorporated. The DMD is illuminated by the white light beam from the illumination optics. Light from the DMD, which has a pixilated mid-beam profile, is collected by the projection optics, which are a non-telecentric imaging projection lens with the following optically coupled optical elements: a doublet for color correction, cylindrical and anamorphic aspheric lenses that induce anamorphic stretching of the DMD light to match the FOV, and a standard lens for aberration correction.

Other Embodiments

While the disclosure has been described with respect to a limited number of embodiments, those skilled in the art, having benefit of this disclosure, will appreciate that other embodiments can be devised which do not depart from the scope of the disclosure as disclosed herein.

For example, embodiments of a headlamp have been described herein that include a high beam booster module, a DMD headlight module, and a low beam module. One of ordinary skill in the art will understand embodiments in which the low beam module and the high beam module are not present and the DMD headlight module projects white light with a beam profile combining high beam, mid beam, and low beam profiles. Further, one of ordinary skill in the art will understand embodiments in which the low beam module is not present, and the DMD headlight module projects white light with a beam profile combining mid beam and low beam profiles.

Certain terms are used throughout the description and the claims to refer to particular system components. As one skilled in the art will appreciate, components may be referred to by different names and/or may be combined in ways not shown herein without departing from the described functionality. This document does not intend to distinguish between components that differ in name but not function. In the discussion and in the claims, the terms "including" and "comprising" are used in an open-ended fashion, and thus should be interpreted to mean "including, but not limited to . . . ."

It is therefore contemplated that the appended claims will cover any such modifications of the embodiments as fall within the true scope of the disclosure.

What is claimed is:

1. A headlamp comprising:
- a light source configured to provide first light;
- a digital micromirror device (DMD);
- illumination optics optically coupled between the light source and the DMD, the illumination optics configured to illuminate the DMD with the first light, the DMD configured to reflect the first light as pixelated light having a first brightness level; and
- a module configured to provide second light having a second brightness level different than the first brightness level.

2. The headlamp of claim 1, further comprising projection optics optically coupled to the DMD, the projection optics configured to project the pixelated light as a first portion of a projected light beam, wherein a second portion of the projected light bean comprises the second light, the first portion shaped by at least the DMD and the illumination optics, wherein a field of view and an intensity of the projected light beam are controllable by the light source and the DMD.

3. The headlamp of claim 2, wherein the projection optics are configured to project the second portion of the projected light beam.

4. The headlamp of claim 3, wherein the projection optics are configured to project a third portion of the projected light beam having a third brightness level.

5. The headlamp of claim 1, wherein the module is a first module, the headlamp further comprising a second module configured to provide third light having a third brightness level.

6. The headlamp of claim 1, wherein the light source comprises a phosphor, additional illumination optics, and one or more blue laser diodes, blue light from the one or more blue laser diodes formed by the additional illumination optics to produce a high intensity Gaussian spot on the phosphor.

7. The headlamp of claim 1, wherein the pixelated light is white light.

8. The headlamp of claim 1, wherein the second brightness level is brighter than the first brightness level.

9. A method comprising:
- providing, by a light source, first light;
- illuminating, by illumination optics, a digital micromirror device (DMD), with the first light;
- reflecting, by the DMD, the first light as pixelated light having a first brightness level; and
- providing, by a module, second light having a second brightness level different than the first brightness level.

10. The method of claim 9, further comprising projecting, by projection optics, the pixelated light as a first portion of a projected light beam, wherein the second light is a second portion of the projected light beam, the first portion shaped by at least the DMD and the illumination optics.

11. The method of claim 10, further comprising projecting, by the projection optics, the second light.

12. The method of claim 9, wherein the module is a first module, the method further comprising providing, by a second module, third light having a third brightness level.

13. The method of claim 9, wherein the light source comprises a phosphor, additional illumination optics, and one or more blue laser diodes, blue light from the one or more blue laser diodes formed by the additional illumination optics to produce a high intensity Gaussian spot on the phosphor.

14. The method of claim 9, wherein the pixelated light is white light.

15. The method of claim 9, wherein the second brightness level is brighter than the first brightness level.

16. A vehicle comprising:
- a first headlamp comprising:
  - a light source configured to provide first light;
  - a digital micromirror device (DMD);
  - illumination optics optically coupled between the light source and the DMD, the illumination optics configured to illuminate the DMD with the first light, the DMD configured to reflect the first light as pixelated light having a first brightness level; and
  - a module configured to provide second light having a second brightness level different than the first brightness level; and
- a second headlamp.

17. The vehicle of claim 16, further comprising projection optics optically coupled to the DMD, the projection optics configured to project the pixelated light as a first portion of a projected light beam, wherein the second light is a second portion of the projected light beam.

18. The vehicle of claim 17, wherein the projection optics are configured to project the second portion of the projected light beam.

19. The vehicle of claim 16, wherein the module is a first module, the first headlamp further comprising a second module configured to provide third light having a third brightness level.

20. The vehicle of claim 16, wherein the second brightness level is brighter than the first brightness level.

* * * * *